United States Patent [19]

Parsons

[11] 4,063,520

[45] Dec. 20, 1977

[54] NIGHT DEPOSITORY CLOSURE

[75] Inventor: Kenneth A. Parsons, Toledo, Ohio

[73] Assignee: The Meilink Steel Safe Company, Toledo, Ohio

[21] Appl. No.: 682,127

[22] Filed: Apr. 30, 1976

[51] Int. Cl.[2] ..... E05G 1/026

[52] U.S. Cl. ..... 109/66; 232/44

[58] Field of Search ..... 109/66, 23 A; 232/44, 232/43.3

[56] References Cited

U.S. PATENT DOCUMENTS

| | | | |
|---|---|---|---|
| 2,617,584 | 11/1952 | Behrens | 232/44 |
| 3,465,955 | 9/1969 | De Boer et al. | 232/44 |
| 3,784,090 | 1/1974 | Markham | 232/44 |

*Primary Examiner*—Paul R. Gilliam
*Assistant Examiner*—David H. Corbin
*Attorney, Agent, or Firm*—Hugh Adam Kirk

[57] ABSTRACT

A rockable customer operated door for a chute to a safe type receptacle as in a bank for receiving parcels and/or envelopes, which door may be unlocked by a key, and when opened exposes a pocket into which a parcel or letter may be dropped, and which during the manual closing of the door, a pivoted wall of the pocket ejects the contents thereof into the chute. Spring urged lever and ratchet means control the movement of the pocket wall to not only eject its contents but to scrape the walls thereof as well as to prevent reversing movement of the door intermediate the ends of its travel. Movable trunnion pivots for the door are provided for removing the door for repairs to its mechanism. The lever means pivoted to the door is provided with pins that cooperate with the ratchet means which is pivoted to the frame for the door that is rigidly mounted in the opening of the chute. Stops and toggle means are provided for controlling and limiting the movement of the door, the movable pocket wall, and the lever means. The key lock for the door comprises a pinion for a rack type bolt.

44 Claims, 20 Drawing Figures

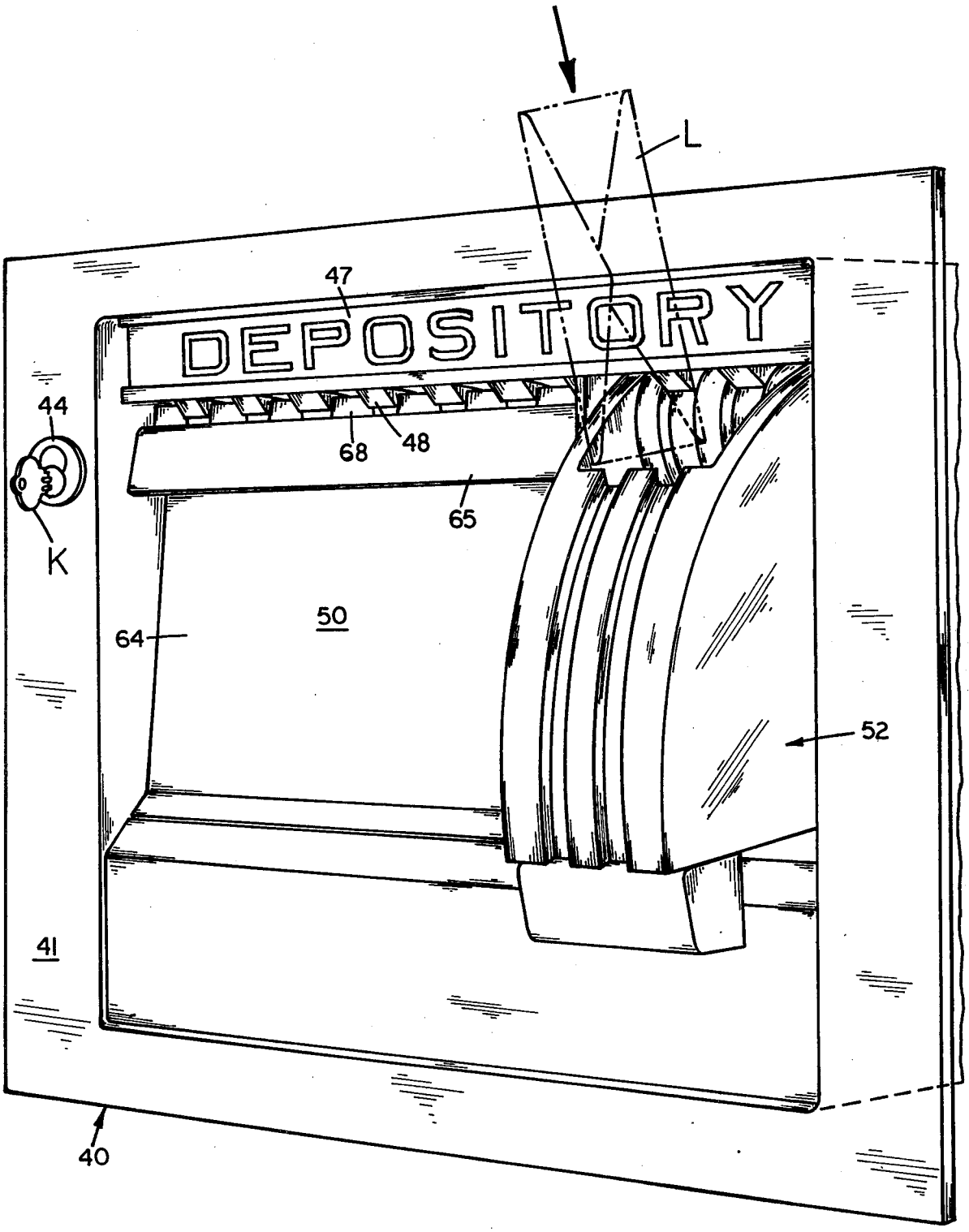
FIG. II

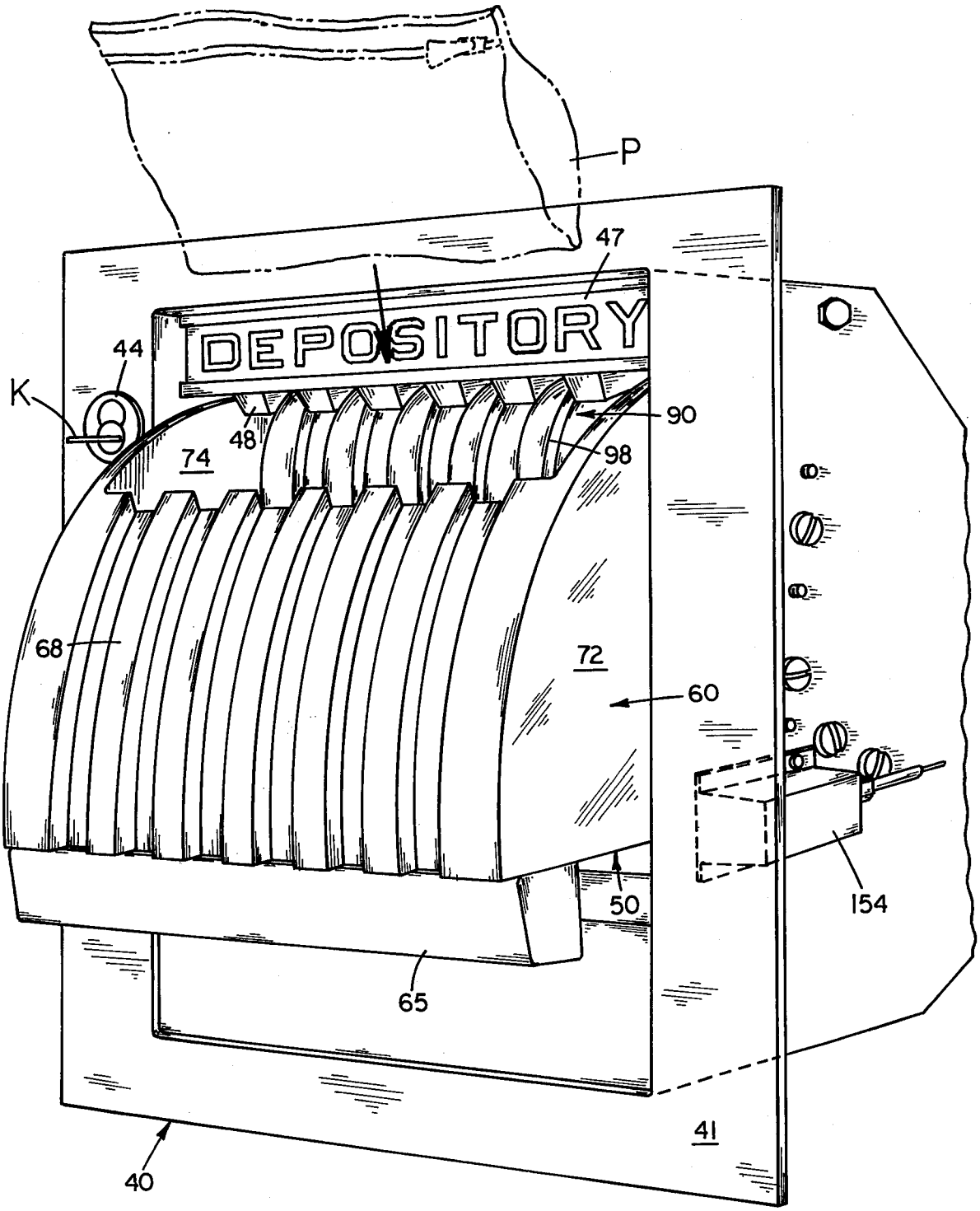
FIG. III

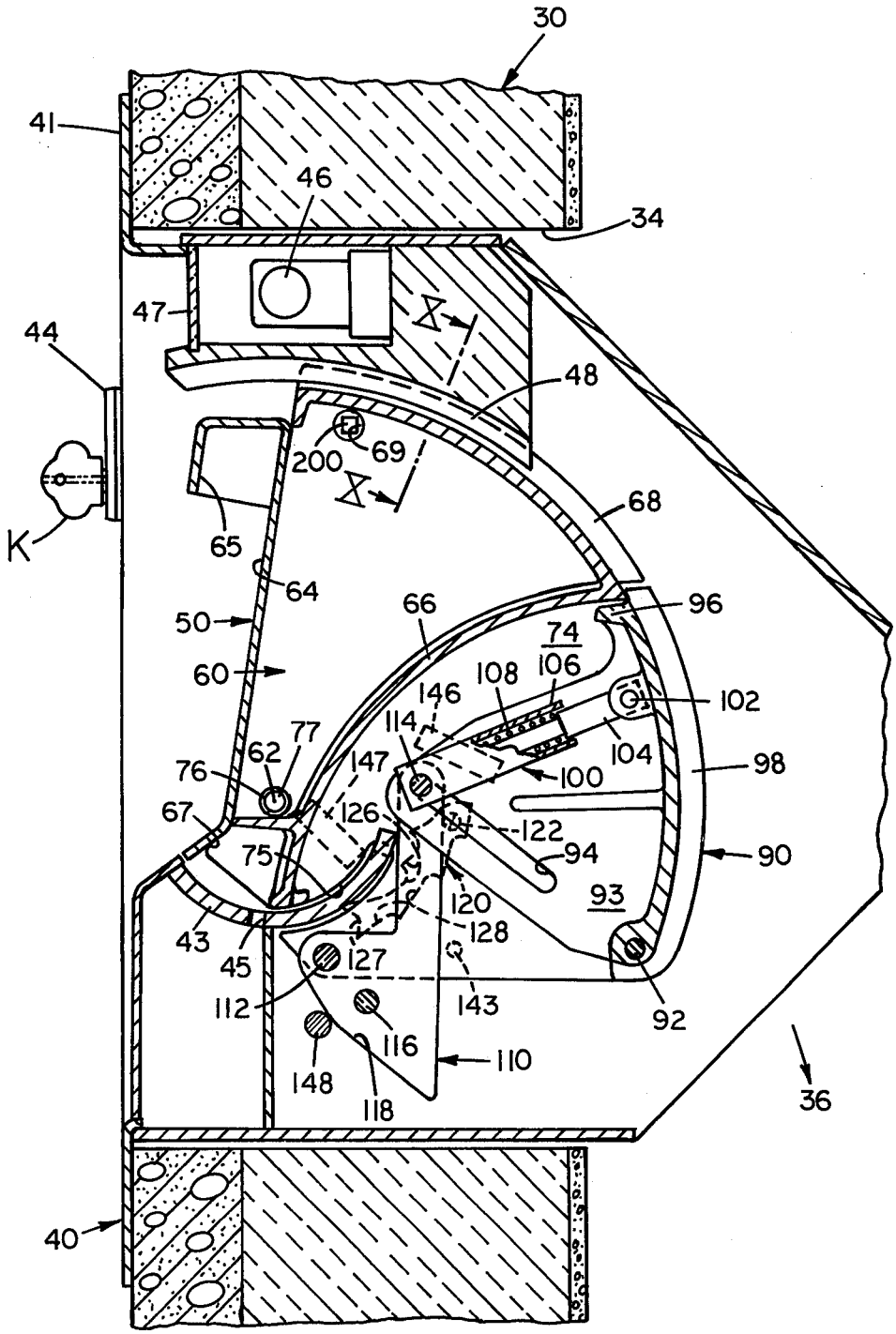
FIG. IV

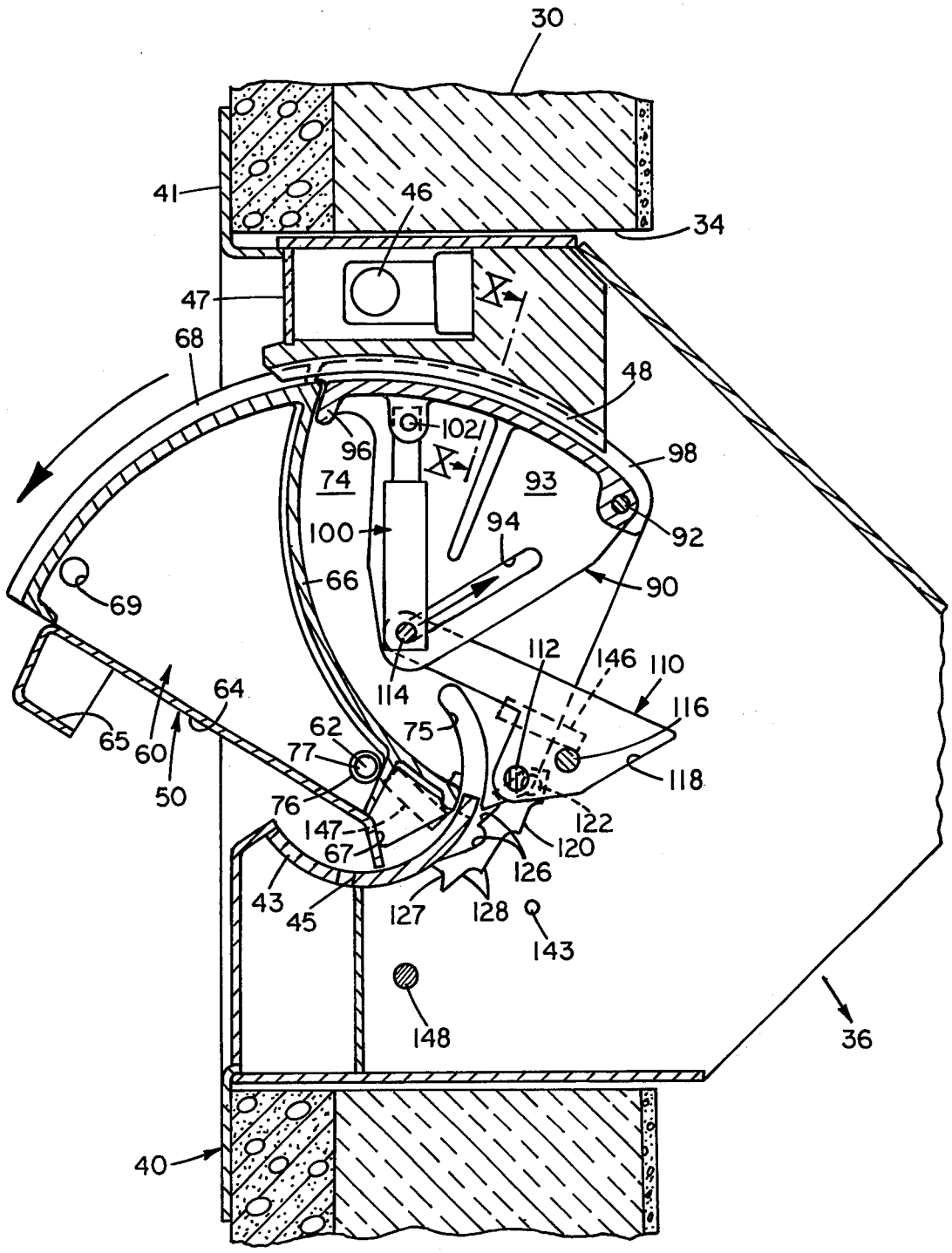
FIG. V

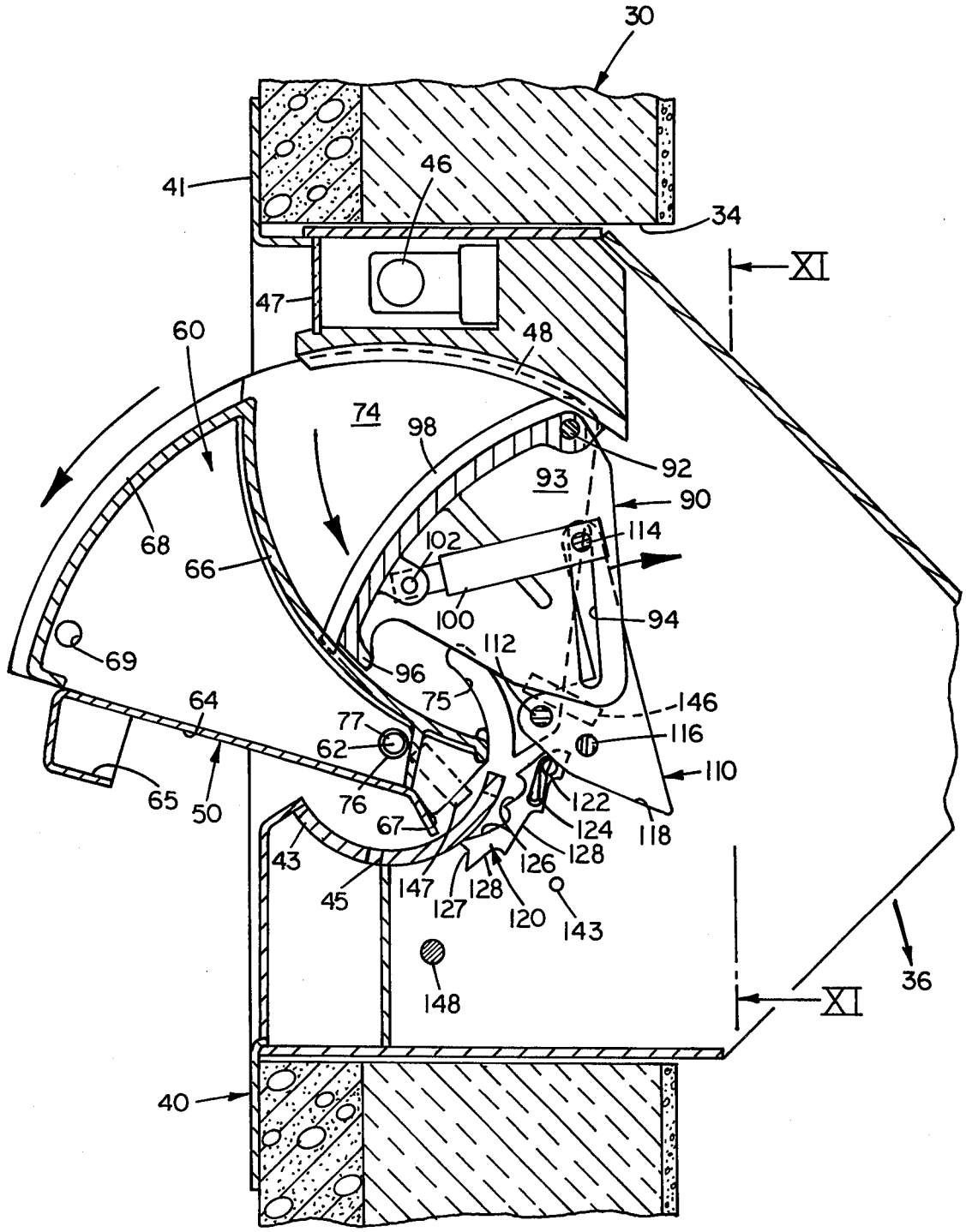
FIG. VI

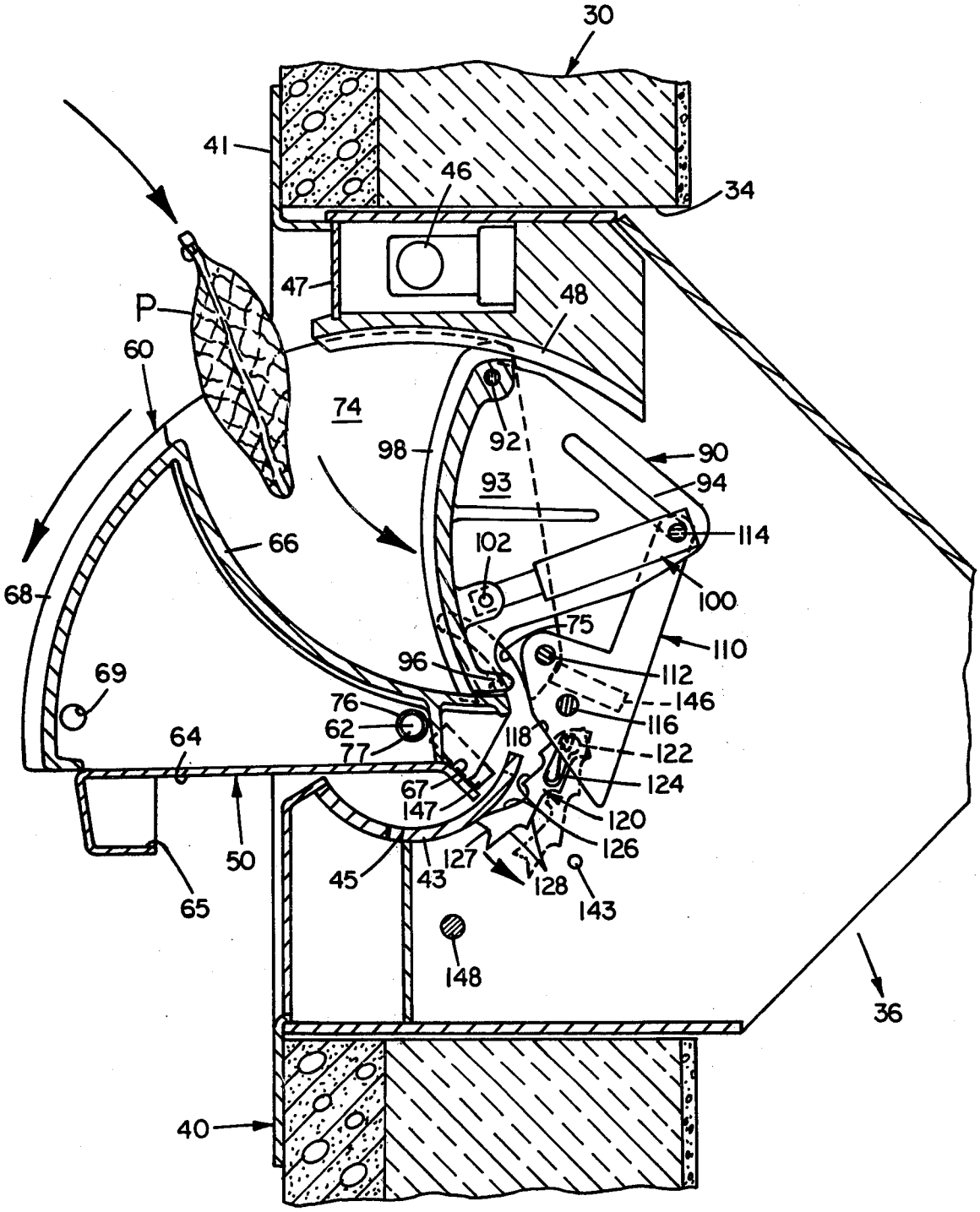
FIG. VII

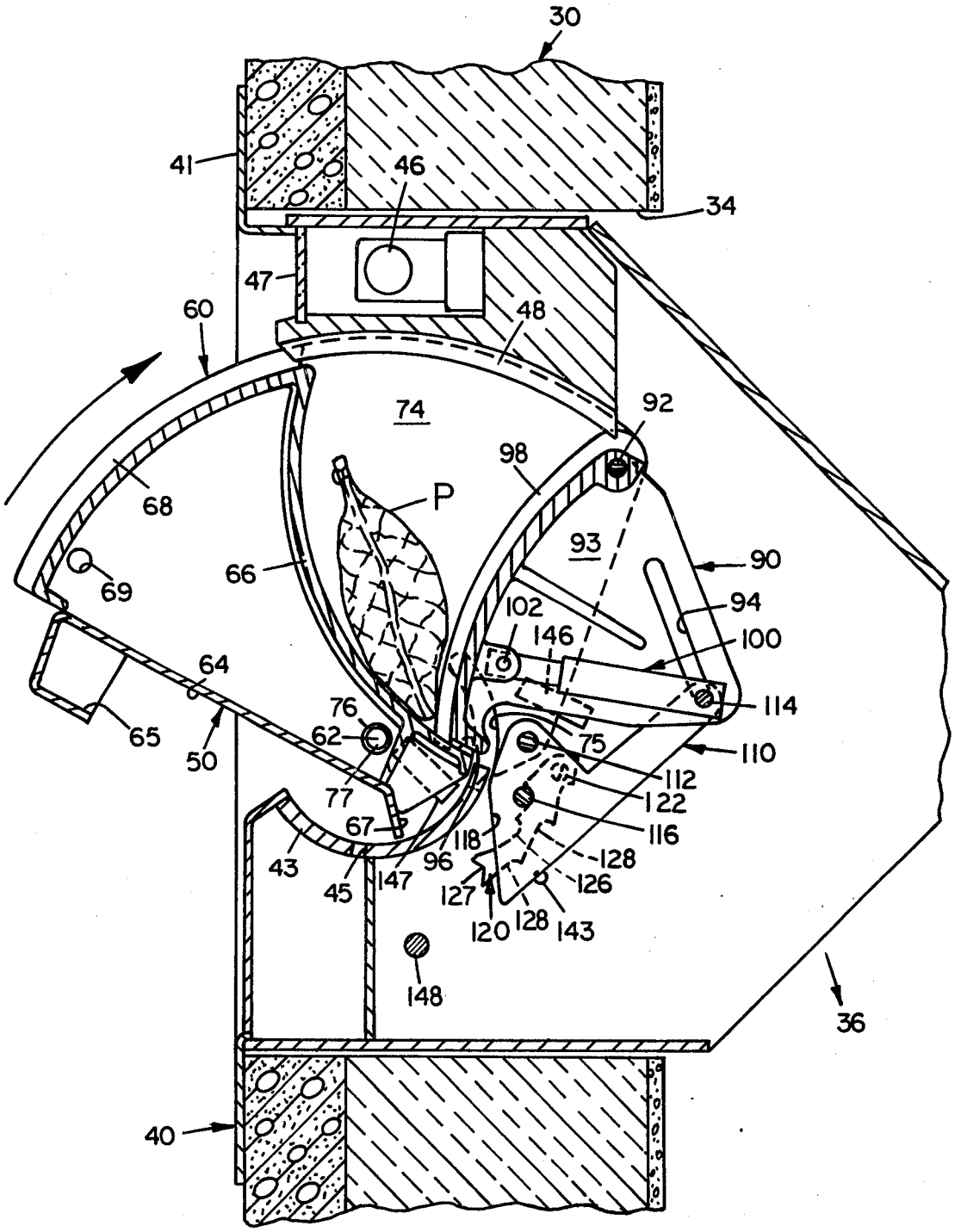
FIG. VIII

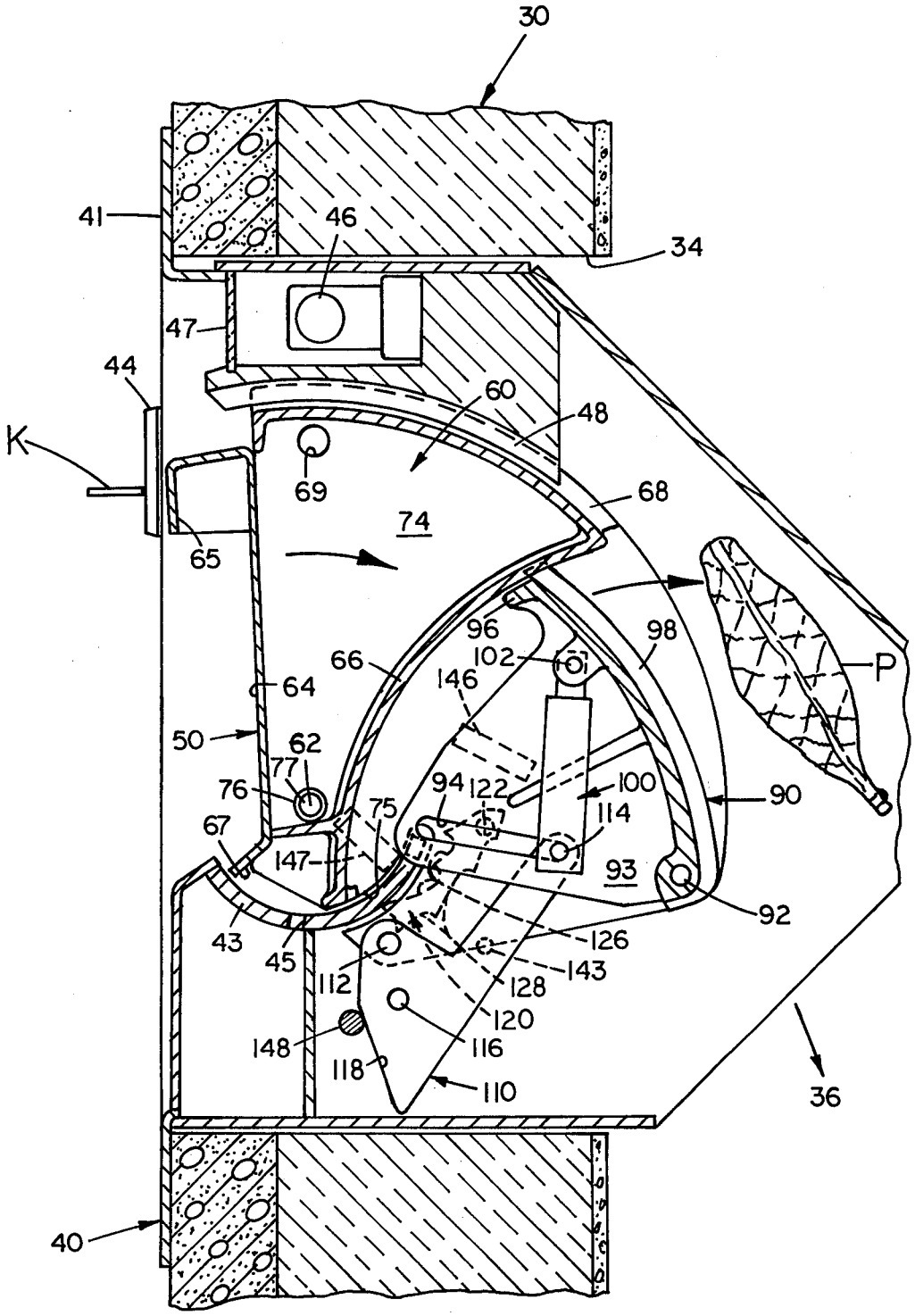
FIG. IX

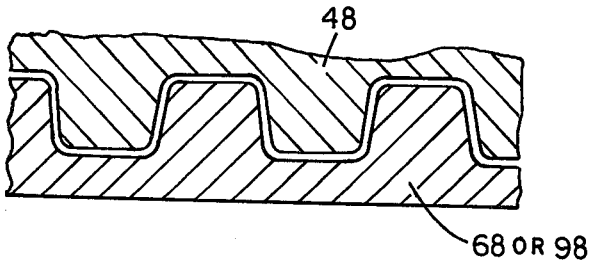
FIG. X
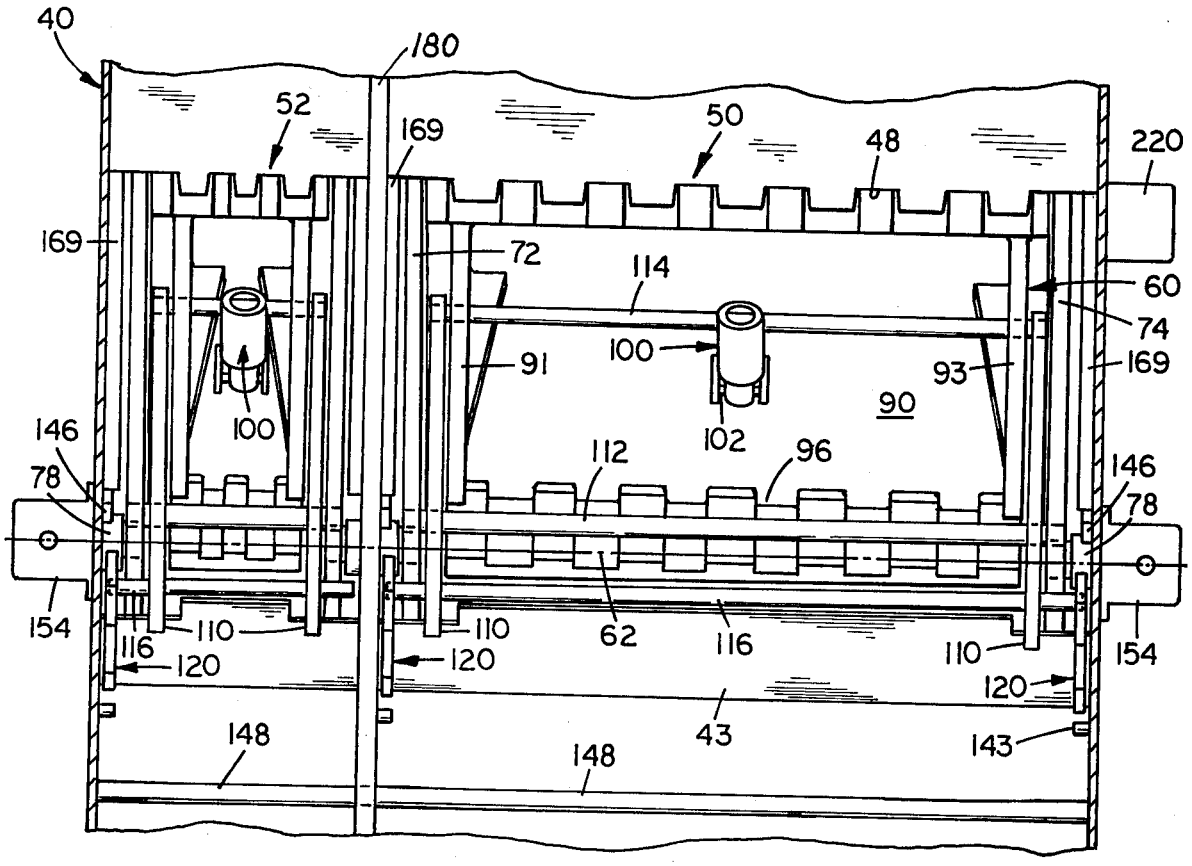
FIG. XI

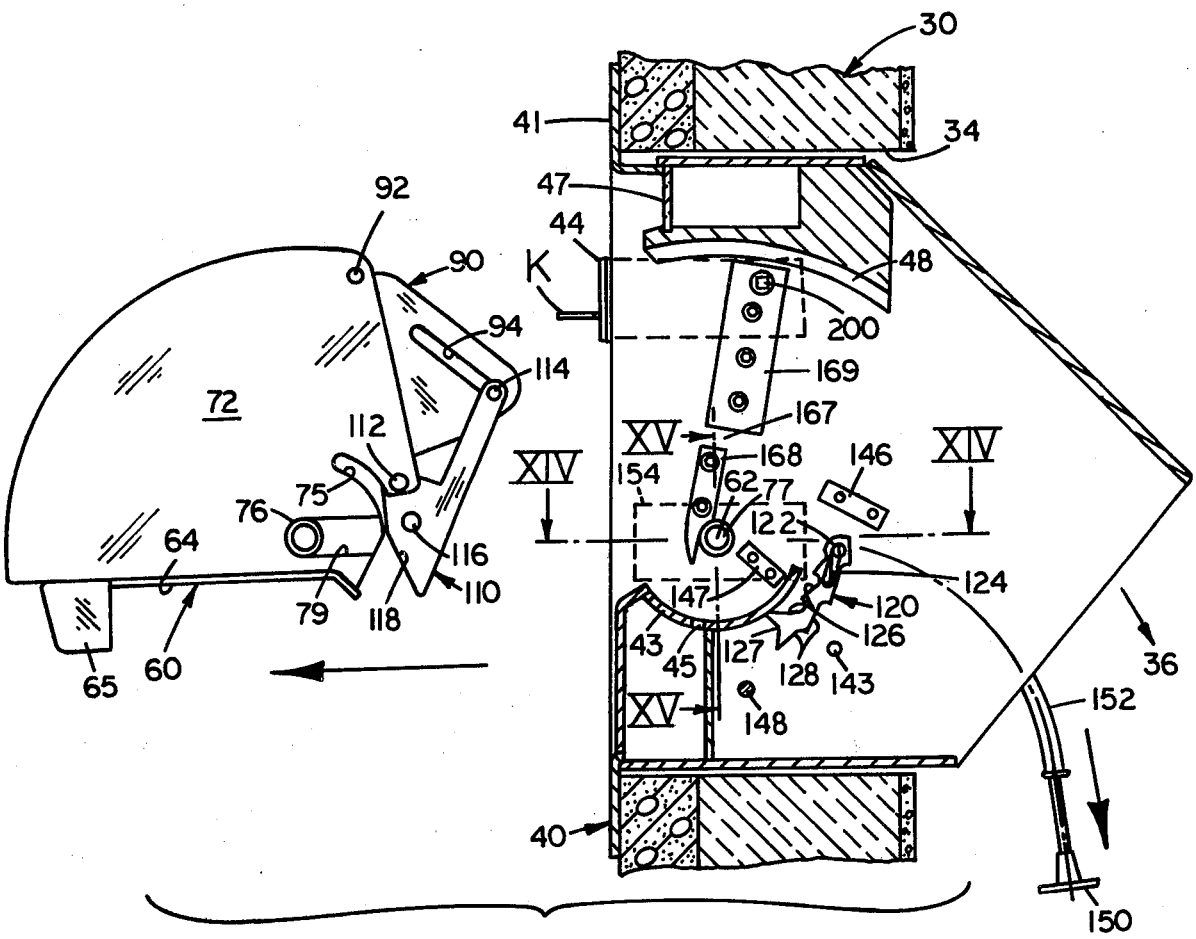
FIG. XII
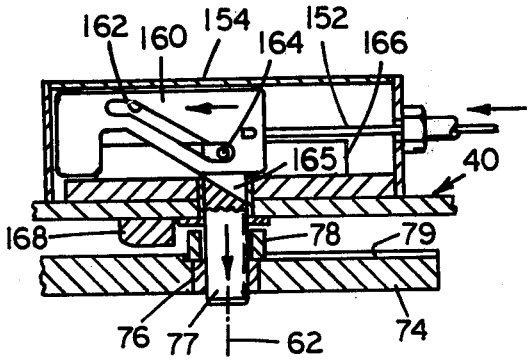
FIG. XIII
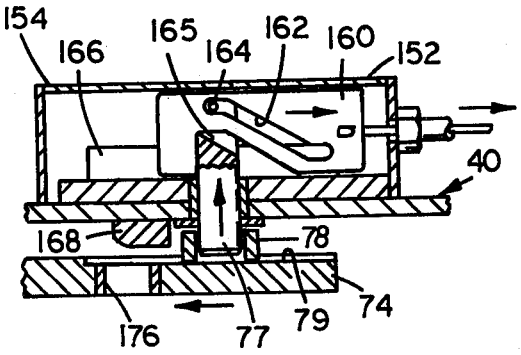
FIG. XIV

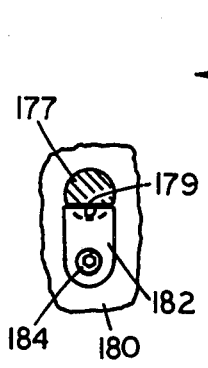
FIG. XVI
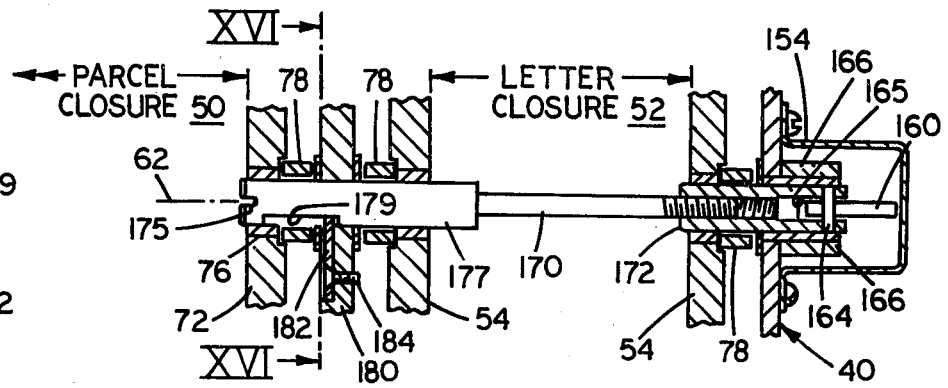
FIG. XV
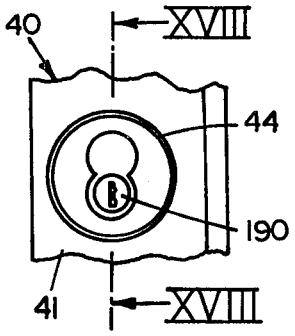
FIG. XVII
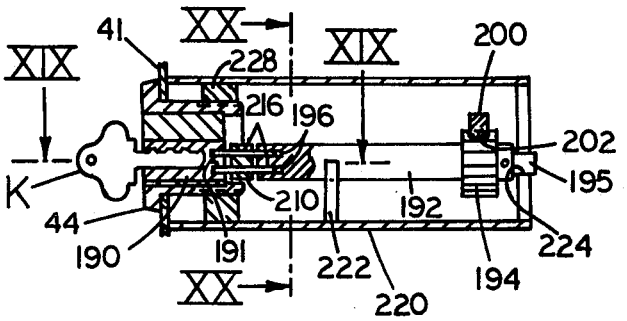
FIG. XVIII
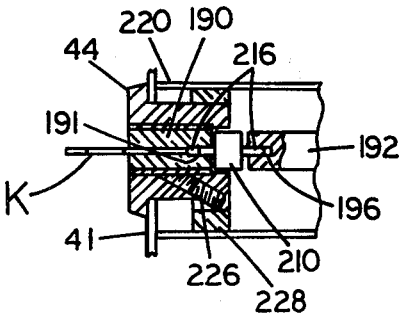
FIG. XIX
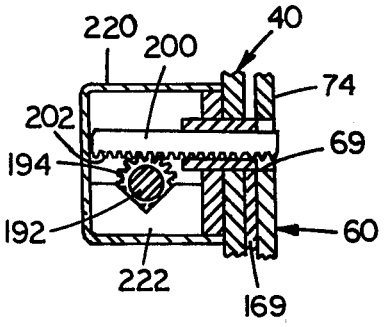
FIG. XX

NIGHT DEPOSITORY CLOSURE

BACKGROUND OF THE INVENTION

Previous bank night depository closures involved rotating or oscillating doors, straight line movable ejectors, and/or complicated lever and cam mechanisms for controlling the same, with and without special mechanisms for preventing unauthorized access and/or reversible movement of such closures.

SUMMARY OF THE INVENTION

Generally speaking, the night depository closure of this invention is for the opening at the upper end of a chute which passes through a wall in a bank and opens into a safe or vault type receptacle that can only be opened by authorized personnel. The closure in the bank wall is manually operable by customers or depositors of the bank, and is journalled in a frame around the opening in the wall. This frame may contain a light source and/or a key lock for illuminating and locking the closure, respectively. This closure comprises a sector shaped door whose axis is pivoted horizontally along the lower edge of the frame, and when opened exposes a pocket in its arcuate side into which parcels and envelopes can be dropped. Separate parallel closures may be provided for parcels and letters. As the door is rocked closed, the parcel dropped therein is ejected into the chute and falls into the safe receptacle. In order to prevent unauthorized access into this safe through the sector shaped door, there are provided means whereby the door cannot be jammed or reversed in its movements and after each closing to scrape off the walls of its pocket into the chute.

A pull type handle is provided on the outer angle side of the sector shaped door and the other angle side of the sector is provided with a pivoted wall which forms the pocket for the parcels to be deposited, which pivoted wall moves to eject and scrape out the contents of the pocket when the door is closed.

The pivots for the door comprise trunnions which may be retracted by cam slots moved by bowden type wires with knobs preferably located inside the safe type receptacle so that access for removing the door can only be had by authorized personnel. Once the trunnions are axially retracted, the door may be pulled out of the opening in the top of the chute by means of its handle thereon, so that easy access may be had to its lever, ratchet and bolt locking mechanisms for maintenance and repairs. Around each of the trunnions are provided hardened freely rotatable rings so that if a saw blade is placed between the frame and the door it cannot get a bite on the trunnions.

The key locking mechanism may comprise a tumbler type lock with a special key so that the tumbler may be removed, and the lock housing unscrewed for access to a double pronged connector for its removal from a pinion that operates a rack type bolt that engages a seat in the side of the sector shaped door.

The arcuate side of the sector shaped door, and of the wall of pocket therein are preferably grooved to mesh with each other and with grooves in the top of the frame, so that as the door is moved there is a type of interfitting combing of the inner surfaces of the pocket walls for scraping out anything that may adhere to the pocket walls.

A lever is pivotally mounted on one or both sector shaped sides of the movable door and is connected by a pin in a slot in the movable wall of the pocket, which lever co-acts with stops mounted in the frame and with a depending spring-urged ratchet pivoted to the frame. Between the pin or shaft on the lever that rides in the slot in the pocket wall and the movable door is an outwardly urged link which may be damped which acts as a toggle for insuring two extreme positions of the pocket wall, namely its open and closed pocket positions. Fixed stops on the frame limit the relative movements of the door and lever to move the pocket wall between its extreme positions only during the movement of the door when the pocket therein is inside the frame and not visible to the customer. An additional pin on the lever engages the spring pressed toothed or notched ratchet to prevent the reverse movement of the door once the pocket is invisible to the customer. This ratchet also has teeth to prevent opening of the door in the event that the toggle and/or ratchet spring is reversed or jammed, such as by a wire being inserted surreptitiously between the grooves of the door and hooking on these mechanisms.

OBJECTS AND ADVANTAGES

Accordingly, it is an object of this invention to produce a simple, efficient, effective, corrosion resistant, easily repairable, and burglar proof night depository closure for banks, and the like.

Another object is to provide such a closure having a mechanism of relatively few moving parts which is strong and resists unauthorized access, and is completely mechanically and manually operable by the customers.

Another object is to provide a depository closure which cannot be reversed once the compartment or pocket for the receptacle has been moved towards its closed position out of view of the depositor or customer, and to provide means for wiping the walls of the pocket before it can be opened again to insure that no parcel from a preceding depositor is stuck in the pocket for a succeeding depositor.

Another object is to provide a night depository closure that will prevent opening thereof if its mechanism has been tampered to move its mechanism out of its normal operative positions.

Still another object is to provide a depository closure which exposes no crevices into which tools may be wedged or pried to try to gain or force unauthorized access to the safe type receptacle below it.

BRIEF DESCRIPTION OF THE VIEWS

The above mentioned and other features, objects and advantages, and a manner of obtaining them are described more specifically below by reference to embodiments of this invention shown in the accompanying drawings wherein:

FIG. I is a left front side perspective view of one embodiment of a night depository according to this invention, showing its attached chute and safe type receptacle, with parts of the walls broken away;

FIG. II is a right front perspective view of the closure shown in FIG. I, with its letter closure open and a letter in dotted lines being inserted therein;

FIG. III is a perspective view similar to FIG. II but of an embodiment without a separate letter closure and showing the parcel closure in its open position and a parcel in dotted lines being inserted therein;

FIG. IV is a vertical sectional view taken along line IV—IV of FIG. I, showing the sector shaped closure door closed with its pocket wall in its parcel ejecting position;

FIG. V is a sectional view similar to FIG. IV, showing the door partially opened, and the ejecting pocket wall being scraped off against the top of the closure frame;

FIG. VI is a sectional view similar to FIGS. IV and V, with the door three-quarters open, and the pocket ejecting wall partially retracted;

FIG. VII is a sectional view similar to FIG. IV but with the door completely opened and a parcel being dropped into the completely opened pocket therein, as also shown in FIG. III;

FIG. VIII is a sectional view similar to FIG. VI in which a parcel has been placed in the pocket in the door and the door has been partly closed to the position where the pocket is invisible and the ratchet engages a pin on a lever to prevent reopening of the door;

FIG. IX is a sectional view similar to FIG. IV in which the door is substantially closed and the pocket wall has moved to eject the parcel from the pocket into the chute;

FIG. X is an enlarged sectional view taken along line X—X of FIG. IV or V showing interfitting scraping grooves of door, frame and pocket wall;

FIG. XI is a rear view taken along line XI—XI of FIG. VI showing the locations of toggle, levers, ratchets and stops with respect to the frame and movable wall of the pocket;

FIG. XII is a sectional view similar to FIG. IV but on a slightly reduced scale, showing the removal of the door from the frame;

FIG. XIII is an enlarged sectional view taken along line XIII—XIII of FIG. I showing the cam mechanism for retracting a trunnion pivot at the side of the door frame, the trunnion being extended to its door supporting and pivoting position;

FIG. XIV is a view similar to FIG. XIII and taken along line XIV—XIV in FIG. XII, showing the cam in its other or trunnion retracted position for the removement of the door;

FIG. XV is an enlarged sectional view along line XV—XV of FIG. XII of the shaft for the letter depository as shown in FIGS. I and II, showing the retractable parcel-pocket trunnion on the left end of the unscrewable shaft for the letter closure;

FIG. XVI is a sectional view taken along line XVI—XVI of FIG. XV showing how the shaft is locked into position;

FIG. XVII is an enlarged front view of the lock shown at the left side of the frame in FIGS. I, II, and III;

FIG. XVIII is a vertical sectional view taken along line XVIII—XVIII of FIG. XVII showing the lock mechanism including the tumbler lock, double pronged connector, and pinion for operating the rack bolt;

FIG. XIX is a horizontal sectional view taken along line XIX—XIX of FIG. XVIII showing how the tumbler lock can be locked into its housing by set screw; and FIG. XX is a vertical sectional view taken along line XX—XX of FIG. XVIII showing the rack and pinion for operating the bolt lock for the door.

DETAILED DESCRIPTION OF PREFERRED EMBODIMENTS

A. Depository in General

Figure 1:
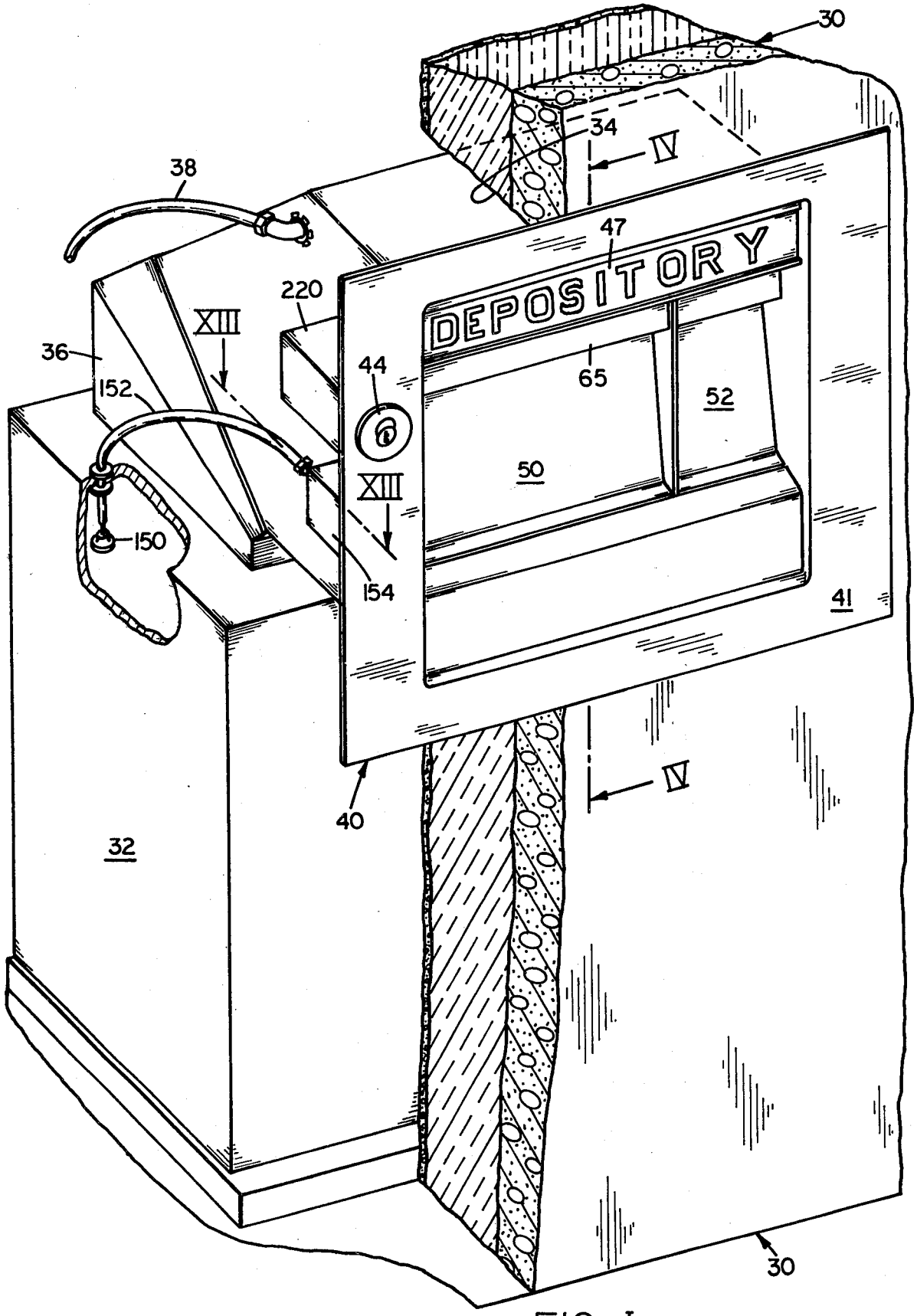

Referring first to FIG. I, there is shown a wall 30 of a building such as a bank, inside of which wall may be located a safe type of receptacle 32. The wall 30 is provided with an opening 34 (see FIG. IV) into which is anchored a rectangular frame 40 and from which frame extends a duct or chute 36 completely enclosed and sealed to an opening into the top of the safe or receptacle 32. An electric conduit 38 may be connected to the frame 40 for supplying electricity to a bulb for illuminating the sign "Depository" in the top of the frame 40, and/or also for illuminating the front of openable closures 50 and 52 for parcels P (see FIG. III) and letters L (see FIG. II), respectively. The closure or door 50 may be locked and unlocked by a key K in a tumbler lock 44 mounted in the outside surface of the frame 40.

Thus a customer or a depositor, after banking hours, that has a key K may unlock the larger closure 50 for depositing a large amount of cash or a parcel P by pulling open the door 50 until a pocket appears therein, drop the parcel P in the pocket, and then close the door, and relock it with the key K so the key K can be withdrawn from the lock 44. On the other hand, a customer which only has the letter, envelope or small parcel L to deposit, may open the smaller door 52, which similarly is provided with a pocket into which a letter L may be dropped, and then close the door.

The mechanism of the closure 50 or 52 of this invention prevents the access into the chute 36 and thus into the vault 32, and even access into the pockets in the doors 50 and 52, after the pockets are closed sufficiently to be out of view. It is this mechanism that will now be described in detail in the following sections.

The frame 40 may be faced with a stainless steel or other durable attractive face plate 41. Near the bottom of the frame 40 is an arcuate trough 43 as shown in FIGS. IV through IX, XI and XII concentric with the axis 62 of the sector door 60. This trough 43 is provided with drain holes 45 to prevent rain and weather from getting into the chute 36 and safe 32. As previously stated, the upper part of the frame 40 may be provided with a light such as a flurorescent lamp 46 shown in FIGS. IV through IX energized via the electric cable 38 shown in FIG. I, which lamp 46 may illuminate the front handle-side 64 of the closures 50 and/or 52 as well as the sign "Depository" 47 which may be placed across the upper side of the frame 40. Beneath the lamp 46 is provided a concave grooved door frame member 48 with which a cooperating grooved arcuate surface 68 on the door 60 and correspondingly grooved arcuate surface 98 on the pivoted wall 90 interfit as shown in FIG. X.

B. Closures 50, 52

1. Sector Door 60

Referring primarily to FIG. IV, the closure 50 comprises a sector shaped door pivoted near its apex on an axis 62 into the stationary rectangular frame 40. One and the front angle side 64 of this door 60 comprises a stainless steel handle 65 whereby the customer may manually rock or oscillate the door 60 from its closed to open positions as shown respectively in FIGS. IV and VII. The other angular side of the sector shaped door 60 has pivoted at its other corner near the arcuate edge thereof a movable arcuate wall 90 pivoted at 92 and movable from its pocket ejecting position shown in FIG. IV into its full open pocket position shown in FIG. VII. The control of the movement of this pocket wall 90 is by a lever member 110 also pivoted to the door 60 at 112 near and parallel to its pivoted axis 62. This lever 110 is connected to the pivoted wall 90 by a shaft 114 movable in slot 94. Thus the closure 50, and similarly closure 52, each comprise only three parts, namely: a sector shaped door 60, and movable pocket wall 90, and interconnecting lever 110.

The sector shaped door 60 is provided with an arcuate grooved intermediate radial partition or wall 66, whose arc is concentric with the pivot 92 of the movable pocket door 90. Between the outer end of this partition 66 and the handle 65 is the arcuate grooved door-jam-intermeshing and wiping surface 68. Just below this arcuate surface 68 adjacent the outer side 64 or handle 65 is a bolt locking engaging aperture or seat 69. The outer parallel sector shaped sides 72 and 74 of the door 60 also provide end walls for the pocket formed in the inner half portion of the sector shaped door 60. These sides 72 and 74 are each provided with arcuate notches 75 for bridging the arcuate trough 43 in the bottom portion of the frame 40. Concentric of these arcuate notches 75 there are provided in each wall 72 and 74, apertures for the pivotable bearings 76 into which the retractable trunnions 77 journal the oscillating door 60.

The gap between the vertical sides of the frame 40 of the door jam and the side walls 72 and 74 of the oscillating sector shaped door 60 are bridged by hardened freely rotating rings 78 so that if a saw blade is placed in this gap it cannot cut trunnions 77, nor the protective hardened steel rings or sleeves 78 around them (see FIGS. XI, XIII, XIV and XV). Slots 79 are provided in the outer surfaces of the walls 72 and 74 (see FIGS. XII, XIII, XIV and XV) for the assembly of the door 60 with these rings 78 bridging the space between the side walls 72 and 74 and the jam door 40.

B 2. Movable Pocket Wall 90

The pivoted or movable pocket wall 90 has an outer arcuate grooved surface 98 which also may have an inwardly projecting end flange 96 to restrict the insertion of sharpe instruments between its edge and the other arcuate wall 66 of the door 60. This movable pocket wall 90 has triangular sector shaped side walls 91 and 93 which are parallel and in which the slots 94 are provided for the shaft 114 for connection to the levers 110 between these walls 91 and 93 and the sector door walls 72 and 74, respectively.

On this shaft 114 between these walls 91 and 93 and parallel to the axis 62 of the door 60, there is connected a toggle link 100 pivoted at one end 102 to the inside of the movable wall 98 and at the other end to the bar 114. This link 100 may comprise a pair of telescopic members 104 and 106 urged apart by an interior helical spring 108 (see FIG. IV). The action of this spring 108 may be damped by a friction, pneumatic, or hydraulic mechanism to prevent noise when this spring pushes the movable wall 90 into its two extreme positions shown in FIGS. IV or V and VII or VIII, respectively. It is to be noted that this particular outwardly urged spring link 100 acts as a toggle mechanism in these two most extended positions. In all other positions of the toggle link 100, such as shown in FIGS. VI and IX, the toggle link 100 is more compressed and the rod 114 to which it is connected is at the opposite end of the slots 94 from what it is when the link 100 is in its fully extended positions shown in FIGS. IV and VIII.

B 3. Lever 110

The third part of the closure 50 or 52 that moves both with and relative to the door 60 comprises a lever 110 pivoted to the door 60 on the shaft 112 parallel to and near the pivotal axis 62 of the door 60. Connected to one end of the lever 110 is the shaft 114 that slides back and forth in the slot 94 of the movable pocket wall 90. Near the pivot shaft for this lever 110 is a stop pin or rod 116 and a cam surface 118. It is the abutment of this rod 116 and the cam surface 118 against fixed stops mounted on the inside of the two vertical parallel sides of the door jam frame 40 which moves the lever 110 to control the motion of the movable pocket wall 90. Thus until this lever 110 is engaged by one or the other of these fixed stops, it is held by the resilient expandable toggle link 100 into the position shown in either FIGS. IV and V or FIGS. VII and VIII.

The two fixed stops on the vertical side frame 40 which cooperate with the cam surface 118 and the ends of the rod 116 on the lever 110, are respectively, a cylindrical pin or rod stop 148 and rectangular plate stop 146. These stops 148 and 146 are spaced and to be located for engagement near the ends of the travel of the oscillating door 60 so that the movable pocket wall 90 remains in its ejecting position until the door is opened and remains in its pocket forming position until the door 60 is closed.

A third and herein rectangular shaped stop 147 is provided along the vertical door jam of the frame 40 for limiting the opening movement of said door 60 by abutment against it by the lower end 67 of the front radial side wall of the closure 60, as shown in FIG. VII.

B 4. Ratchet 120

Between the fixed stops 146 and 148 are pivoted beneath the stop 146 is a double sided tooth ratchet 120 pivoted at 122 at its upper end adjacent the stop 146, which ratchet 120 is urged by a coil or leaf spring 124 (see FIGS. VI, VII and XII) into its normal upper position (full line position in FIG. VII) so that its lower free end contacts the under side of the drain trough 43 of the frame 40. The opposite oscillating movement of the ratchet 120 may be limited by a fixed pivot or stop 143 mounted on the vertical wall of the frame 40 in the event the spring 124 is ever broken due to jimmying or wear. The teeth 126 along the upper or left hand side of the ratchet 120 and the bottom notch 127 remote from the pivot 122 are engaged by the ends of the stop rod 116 on the lever 110 to prevent the reverse movement of the door 60 once it has been moved into its pocket closed position as shown in FIG. VIII. The notches 128 along the right or lower side of the ratchet 120 are also provided for engaging the ends of the pin or rod 116 in the event the spring 124 is broken, so that the door 60 cannot be opened. Otherwise the spring 124 maintains the lower notches 128 of the ratchet 120 out of the normal path of the pin or rod ends 116 when the door is being opened as shown between the positions of FIGS. IV and V.

Each closure 50 and 52 may be provided with one or a parallel pair of levers 110 and correspondingly cooperating pivoted ratchets 120 along either or both of its parallel vertical side walls of the frame 40. Generally however, the wider and/or larger closure 50 is provided with a pair of parallel levers 110 and cooperating ratchets 120, while the narrower and smaller closure 52 for the letters L may be provided with only one lever 110 and cooperating pivoted ratchet 120 (see FIG. XI).

C. Operation

Referring now to FIGS. IV through IX, successively, the operation of the closure mechanism for either the parcel P or letter L for closure 50 or 52, will be described, in that both closures operate in the same manner.

First considering the operation of the parcel closure 50, the operator or customer therefor must have a key K which is inserted into the lock 44 as shown in FIG. II and turned as shown in FIG. III in order to release the bolt 200 (see FIGS. IV, XII, XVIII and XX) from the bolt lock aperture or seat 69 in the side wall 74 of the closure door 60. This bolt unlocks the door 60 as long as the key K is turned in the position shown in FIG. III, but the key cannot be removed while in this position. Thus the depositor that has a key K must complete the following operation of completely opening and closing the door 60, once it has been opened further than the position shown in FIG. V, before the key K can be removed by returning the bolt to enter into its seat 69 in door locked position. If the depositor, however, does not have a key K and only is to deposit a letter L as shown in FIG. II, this unlocking step is not necessary.

Thus once the closure is unlocked, the depositor reaches for the handle portion 65 on the front panel 64 and pulls the door outwardly and downwardly as shown in FIG. V to open the door 60. During this door opening operation, the grooves in the door jam 48 wipe the grooves 98 on the movable pocket wall 90 to insure that no parcel or letter from the previous depositor could be adhered to this wall 90. When the door reaches the position shown in FIG. V, the pin ends of rod 116 on the lever 110 have moved from the position shown in FIG. IV up below the teeth 128 of the spring urged ratchet 120 so that the pin or rod ends 116 abut against the rectangular stops 146. Now further movement for opening of the door 60 by pulling down on the handle 65 causes the lever 110 to move or rotate clockwise about its pivot 112 on the door sector 60 into the position as shown in FIG. VI which rocks the movable pocket wall 90 downwardly by the movement of the shaft 114 along the slot 94. Thus, as soon as the pocket begins to appear beyond the edge of the upper door jam 48, the wall 90 has already started to form the pocket, which pocket is completely formed when the door is completely opened as shown in FIG. VII. In this position the pin 114 on the lever 110 is moved to the opposite end of the slot 94 (see FIG. VI) and then back again (see FIG. VII) into its other limited position, and is held in its last position by the spring 108 in the expanded link 100.

At this time the parcel P which is to be deposited by the customer or depositor is dropped into the pocket thus formed in the door 60 as shown in FIG. VII, and the door 60 then may be closed. When the door 60 reaches its half way position shown in FIG. VIII, the ends of the rod or pin 116 on the lever 110 move downwardly, above and along the upper side of the ratchet 120 until the pin 116 has engaged the first notch 126 of the ratchet. This engagement prevents any reverse motion of the door 60 by pulling on the handle 65 by the depositor or any other person. Thus once the pocket in the door 60 has been moved so that the pocket is no longer visible to the depositor as shown in FIG. VIII, reverse action of the door 60 is prevented by the teeth 126 along the ratchet 120. These teeth 126 are engaged successively in steps as the door 60 is continued to be closed until it almost reaches its fully closed position as shown in FIG. IX. Then the pins or rod 116 as well as the axial shaft 112 for the lever 110 have passed below the lower notch 127 of the ratchet 120.

Thus as soon as the partition 66 in the door 60 clears the inside door jam 48, a cam surface 118 of the lever 110 engages the stop 148 to start the ejection of the parcel P into the chute 36 as shown in FIG. IX. Simultaneously the outer arcuate end 96 of the grooved wall 98 of the movable wall 90 scrapes the cooperating grooved partition wall 66 and its side walls 72 and 74 of the pocket to insure that no parcel can be or is stuck thereto. Thus, when the door 60 is completely closed, the movable pocket wall 90 is back into the position shown in FIG. IV from that of FIG. IX and the toggle 100 has been moved into its limiting extended position after its pivot rod 114 has been moved back and forth in the slot 94. Now the key K can then be turned to insert the bolt 200 into its seat 69 in the closed door 60 to lock it, and the key removed and the deposit of the parcel P into the safe 32 has been completed. Similarly for the letter closure 52, the ratchet mechanism 120 engaging the pin 116 and axle 112 for the lever 110 prevents reopening of the door closure 52, until the letter L in the pocket in the door 52 has been completely ejected into the safe 32 as is the parcel P shown in FIG. IX.

In the event an unauthorized person tries to jam or pry into the closure 50 or 52, the only possible access other than completely breaking the wall 30 and/or the frame 40 and closure 50 and 52 out of wall 30, is to try to fish with wire in between the sides of the door and its jam. Thus if a hook on a wire could engage either the lever 110 or one of the shafts or pins 114, or 116 associated therewith to move the toggle link 100, or if the ratchet 120 were moved and/or its spring 124 broken to drop the ratchet 120 into its lower position as shown in dotted lines in FIG. VII, the shaft or rod 116 would engage the teeth 128 of the ratchet 120, and will prevent opening of the door.

Furthermore, the fact that the movable pocket wall 90 has the flange 96 at the outer edge thereof, and this wall starts retracting from its package ejecting position shown in FIG. V into its pocket opening position as shown in FIG. VII before the outer edge of the arcuate wall 66 appears, prevents a tool from being inserted under the movable wall 90 to jam any operation which might further permit access into the chute 36 and safe 32.

D. Disassembly

1. Doors

Referring now to FIGS. I, III, XI, XII, XIII, XIV, and XV, there is shown the mechanism for retracting the trunnions 77 which hold the door 60 into the door jam 40 so that this door 50 can be removed easily from the door jam 40 for repair and/or maintenance thereof, as well as access, repair and/or maintenance of the letter door 52, and their stops and ratchets 120 mounted on the frame 40. The removal of this door 60 is shown in FIG. XII after each trunnion 77 has been retracted into the position shown in FIG. XIV. This retraction is accomplished by pulling the knobs 150 (see FIGS. I and XII) at the far end of the bowden wires 152, which wires extend from the housing 154 (see also FIGS. III and XI) on each vertical outside wall of the frame 40. Inside each housing 154 may be a horizontally slidable rectangular jam plate 160 with a diagonal slot 162 having parallel offset ends. In the slot 162 slides a pin 164 diametrically attached across a slot 165 at the outer end of the trunnion shaft 77. This cam plate 160 may be guided in its horizontal movement between two guide plates 166 (see also FIG. XV), and is pulled or pushed from this one limiting position to the other (see FIGS. XIII and XIV) by the knobs 150 at the end of the bowden wires 152. The offset ends of cam slots 162 prevent axial movement of the trunnions 77 at their two extreme positions. Thus the trunnions cannot be retracted unless the bowden wires 152 and knobs 150 are operated. In order to prevent unauthorized access to these knobs 150 they may be placed inside the safe type container 32 as shown in FIG. I, so that only personnel authorized to enter the same may also permit removal of the closure 50 or 52.

Attention is called to the fact that the retraction of the trunnions 77 into their position shown in FIG. XIV is sufficient to remove the door 50 but still to retain the hardened or loosely rotating sleeves 78, which slide in the grooves 79 in the door sides 72 and 72 as previously described. There is also shown in FIG. XII a pair of plates 168 and 169 which may be bolted or otherwise fastened to the vertical inner parallel walls of the door jam or frame 40 to bridge the normal gap between the outer parallel side walls of the closure and its door jam. These members 168 and 169 are provided with a gap 167 between them so that the outwardly extending ends of shaft or pin 116 that engage the ratchet 120, will not prevent removal of the door 60 and also makes for easy assembly of the closure according to this invention.

Referring now to FIGS. XV and XVI, there is shown a shaft 170 which may extend through the letter closure 52 as shown in FIGS. I and II upon which the side walls 54 of the letter door 52 are journalled. In this combination, the parcel door wall 72 and one letter door wall 54 have a common trunnion 177 through the two closures separating wall 180 in the frame 40. This trunnion 177 is fixedly connected onto one end of the fixed shaft 170, which shaft 170 is threaded at its other end into a sleeve 172 which is slotted 165 and has the pin 164 that rides in the cam slot 162 in plate 160. The sleeve 172 and trunnion 177 are also provided with surrounding freely rotatable hardened rings 78.

Thus the operation of the cam 160 as shown in FIG. XV axially moves the whole shaft 170 to retract the trunnion 177 into the position as shown in FIG. XIV, so that the parcel closure 50 or door 60 can be removed as shown in FIG. XII. Then the shaft 170 may be unscrewed from its extension sleeve 172 by a screw driver placed in the slot 175 at the end of the trunnion 177, which end is now exposed by the removal of the closure 50. This shaft 170 can be axially withdrawn so that the letter closure 52 can be removed from its compartment in the frame 40 separated by partition 180 (see FIG. XV). In order to secure the shaft 170 in position, and prevent it being unscrewed surreptitiously, a key 182 shown in FIGS. XV and XVI is countersunk into the wall 180, and held in place by a countersunk screw 184. The edge of this key 182 fits into a notch 179 in the trunnion section 177 of the shaft 170. Thus the key 182 first must be removed before the shaft 170 can be unscrewed and removed.

D 2. Lock

Referring now to FIGS. XVII through XX, the connection and operation of lock for the rack bolt 200 are shown. Herein the tumbler lock 44 has a tumbler 190 which is rotatable by the key K from the position shown in FIG. XVIII to that shown in FIG. XIX. This tumbler 190 is connected to a pinion shaft 192 carrying a pinion 194 which engages the rack teeth 202 of the lock bolt 200. This shaft 192 has a pair of diametrically spaced axially extending apertures 196 at its end adjacent the lock, which apertures 196 are engaged by corresponding pins 216 which project axially outwardly on both sides of a connector member 210. The other side of the pins 216 from those that engage the apertures 196, engage a similar diametrical pair of apertures 191 in the end of the rotatable tumbler 190. This whole assembly may be located in a housing 220 (see also FIG. 1) which may be anchored to an outside vertical wall of the frame 40. Inside this housing 220 may be provided a V-shaped support 222 (see FIGS. XVIII and XX) for aiding and supporting the shaft 192 for easy assembly and disassembly of this locking mechanism. The far end 195 of the shaft 192 may be journalled in an aperture 224 in the rear wall of the housing 220, opposite from that of the tumbler lock 44.

Easy access and disassembly removal of this lock and bolt mechanism may be had by the use of a special key K which is only held by authorized personnel, which will permit the removal of the tumbler 190 so that access may be had to the set screw 226 (see FIG. XIX) in the side of the tumbler housing, which set screw 226 engages an internally threaded ring 228 mounted in and attached to the housing 220. Thus the whole tumbler lock 44 may be unscrewed from the housing 220, and then by the means of pliers the connector 210, and then the shaft 192 may be withdrawn out through the aperture in the outer end of the housing 220 into which the tumbler lock 44 is normally screwed. Since the bolt 200 is provided with rack teeth 202, longitudinally axial withdrawal of the rack 200 may be had from the inside of the frame 40 after the pinion 194 has been removed, or by rotating the pinion 194 to feed out the rack 202.

It is to be understood that the closures according to this invention may comprise just a letter closure as 52 or just a parcel closure as 50, or both, and either or both which may be provided with lock 44 without departing from the scope of this invention. Furthermore, it is to be understood that the container 32 may or may not be a safe, and the chute 36 connected from the closure and its frame 40 to a container may be of any length, however preferably, it should extend downwardly so that gravity will aid in movement of any deposited letter or parcel L or P, respectively, after it has been ejected by the movable wall 90 of the closure of this invention.

While there is described above the principles of this invention in connection with specific apparatus, it is to be clearly understood that this description is made only by way of example and not as a limitation to the scope of this invention.

I claim:

1. A night depository for parcels through a hole in a wall into a compartment comprising a closure for said hole, said closure comprising:

A. a frame around the inside of said hole,

B. a sector shaped door horizontally pivoted at its apex axis near the bottom of said frame and having a handle on its outer angle side, C. a pocket formed in said door by a movable wall horizontally pivoted near the peripheral corner of the other and inner angle side of said sector door, whereby said wall acts as an ejector for parcels placed in said pocket when door is in closed position, the improvement comprising:

D. a lever means pivoted on said door parallel to the pivotal axis of said door and connected to said movable wall of said pocket, said lever means having a pin means thereon, E. a pair of spaced stops mounted on said frame and engageable by said lever means and said pin means for moving said lever means to move said movable wall, and F. a ratchet means pivoted to said frame and engageable by said pin means on said lever means to prevent reversing movement of said door intermediate its opened and closed positions.

2. A closure according to claim 1 wherein said frame is rectangular in shape.

3. A closure according to claim 1 including chute between said frame and said compartment.

4. A closure according to claim 1 wherein said compartment comprises a safe.

5. A closure according to claim 1 wherein said frame includes means for illuminating said outer angle side of said door.

6. A closure according to claim 1 wherein the arcuate surface of said sector shaped door is grooved circumferentially and the adjacent portion of said frame is complimentarily grooved.

7. A closure according to claim 1 wherein said sector shaped door comprises an intermediate radial wall forming another wall of said pocket.

8. A closure according to claim 7 wherein said intermediate wall is arcuate having its radial center axially with the pivot for said movable wall.

9. A closure according to claim 8 wherein said radial wall has a grooved surface and said movable wall has a cooperating comb edge for scraping said grooved surface.

10. A closure according to claim 1 wherein said movable wall has a grooved surface and said frame has a cooperating comb edge for scraping said grooved surface.

11. A closure according to claim 1 including means for locking said closure in its closed position.

12. A closure according to claim 11 wherein said locking means comprises a tumbler key lock.

13. A closure according to claim 11 wherein said locking means comprises a rack and pinion type bolt mechanism.

14. A closure according to claim 13 including an interfitting connector means between said tumbler lock and said pinion of said bolt mechanism.

15. A closure according to claim 12 including means for locking said tumbler lock into said frame.

16. A closure according to claim 1 wherein said movable wall comprises a slot and said connection between said lever means and said movable wall comprises a second pin means on said lever means movable in said slot.

17. A closure according to claim 1 including an expandable link between said lever means and said movable wall.

18. A closure according to claim 17 wherein said link comprises a resilient means for urging it into its extended position.

19. A closure according to claim 17 wherein said link is damped in its motion.

20. A closure according to claim 1 wherein the pivot for the said sector shaped door comprises a pair of retractable tunnions mounted in said frame.

21. A closure according to claim 20 including means for axially moving said trunnions.

22. A closure according to claim 21 wherein said trunnion moving means comprise bowden wires connected between said trunnions and remote handle means.

23. A closure according to claim 22 wherein said handle means are located inside said compartment.

24. A closure according to claim 22 wherein said trunnion moving means comprises cam slots with offset parallel ends for preventing axial movement of said trunnions except by operation of said handle means.

25. A closure according to claim 20 wherein said trunnions are provided with hardened freely rotatable sleeves bridging the gaps between the frame and the parallel sides of said door.

26. A closure according to claim 1 wherein said sector shaped door is provided with a seat for a locking bolt.

27. A closure according to claim 1 having said lever means, said stops and said ratchet means on each side of said door.

28. A depository according to claim 1 comprising a pair of parallel closures mounted on a common horizontal axis and separated by a partition in said frame.

29. A closure according to claim 28 wherein the axis of one of said pairs of closures in said frame comprises a stationary removable shaft.

30. A closure according to claim 29 including means for locking said shaft from rotation by a key mounted in said partition between said closures.

31. A closure according to claim 1 wherein said ratchet means has notches along opposite sides thereof.

32. A closure according to claim 1 wherein said ratchet means has a spring means for urging said ratchet means in one direction about its pivot.

33. A closure according to claim 1 including a stop means for limiting the movement of said ratchet means.

34. A closure according to claim 1 wherein said frame comprises a drained trough cylindrically concentric with the axis of said closure along the lower portion of said frame.

35. A closure according to claim 1 including a stop means mounted in said frame for limiting the opening movement of said door.

36. In a night depository for parcels through a hole in a wall of a bank into a safe and having a closure for said hole, said closure comprising:

A. a rectangular frame around the inside of said hole,

B. at least one sector shaped door horizontally pivoted at its apex axis near the bottom of said frame for oscillation therein and having the handle at the outer angle side of said door, C. means for locking said door in said frame, and D. a substantially V-shaped pocket formed in the inner half of said sector door by a movable wall horizontally pivoted near the peripheral corner of the other and inner angle side of said sector door, whereby said wall acts as an ejector for the contents of said pocket when said door is moved into its closed position, the improvement comprising:

E. at least one lever means pivoted on one vertical side of said door near and parallel to the pivotal axis of said door, said lever means being connected to said movable wall of said pocket and said lever means having a pin means parallel to said pivotal axis towards same frame, F. a normally extendable toggle link means extending between said lever means and said movable wall for urging said wall into its two extreme positions of complete ejection of the contents of said pocket and the forming of said pocket, G. a plurality of stops mounted on the vertical wall of said frame adjacent said lever means for engaging said lever means to move said vertical wall into its said extreme positions towards the ends of the oscillation of said door from its fully closed to its fully opened position, and vice versa; and H. a latch means pivoted at its upper end to said frame and adjacent said pin means, said latch having a plurality of notches along at least one side thereof whereby engagement of said pin means with said notches prevents the reversal of the oscillation of said door after it has been closed sufficiently to move said pocket into said frame.

37. A depository according to claim 36 comprising a larger parcel receiving sector shaped door and a parallel smaller letter receiving sector shaped door.

38. A depository according to claim 37 including a partition in said frame between said doors.

39. A depository according to claim 36 wherein said locking means comprises a key tumbler type lock and rack and pinion bolt mechanism for engaging the side of said door.

40. A depository according to claim 36 wherein said lever means comprises a cam surface end for engaging one of said stops on said frame.

41. A depository according to claim 36 wherein one of said stops is engageable by said door for limiting the full open position of said door.

42. A depository according to claim 36 wherein said toggle means includes means for damping its action.

43. A depository according to claim 36 wherein the pivot for said door comprise retractable trunnions.

44. A depository according to claim 43 including means for retracting said trunnions from inside said safe, whereby said door may be removed from said frame.

* * * * *